US006290456B1

(12) United States Patent
Fichter et al.

(10) Patent No.: US 6,290,456 B1
(45) Date of Patent: Sep. 18, 2001

(54) VENTILATOR WITH BRUSH TYPE BLOCKING DEVICE

(75) Inventors: Rolf Fichter, Fellbach; Ralf Widmann, Stuttgart, both of (DE)

(73) Assignee: LTG Aktiengesellschaft (DE)

( * ) Notice: Subject to any disclaimer, the term of this patent is extended or adjusted under 35 U.S.C. 154(b) by 0 days.

(21) Appl. No.: 09/491,412

(22) Filed: Jan. 26, 2000

(30) Foreign Application Priority Data

Aug. 31, 1999 (EP) ..... 99117074

(51) Int. Cl.[7] ..... F04D 5/00

(52) U.S. Cl. ..... 415/53.1; 415/173.3; 415/174.2; 415/119

(58) Field of Search ..... 415/53.1, 119, 415/173.3, 174.2

(56) References Cited

U.S. PATENT DOCUMENTS

| | | | | |
|---|---|---|---|---|
| 4,398,508 | | 8/1983 | Moon et al. | 123/41.49 |
| 4,526,509 | * | 7/1985 | Gay, Jr. et al. | 415/173.3 |
| 5,183,382 | | 2/1993 | Carroll | 415/173.6 |
| 5,297,395 | | 3/1994 | Ozu et al. | 62/174 |
| 5,518,364 | * | 5/1996 | Neise et al. | 415/119 |
| 5,752,802 | | 5/1998 | Jones | 415/170.1 |
| 5,941,685 | * | 8/1999 | Bagepalli et al. | 415/173.3 |

FOREIGN PATENT DOCUMENTS

| | | |
|---|---|---|
| 3048571 | 7/1982 | (DE) . |
| 8614073 | 4/1988 | (DE) . |
| 19527605 | 2/1997 | (DE) . |

OTHER PUBLICATIONS

Search Report dated Jan. 17, 2000.

* cited by examiner

*Primary Examiner*—Edward K. Look
*Assistant Examiner*—Ninh Nguyen
(74) *Attorney, Agent, or Firm*—Ostrolenk, Faber, Gerb & Soffen, LLP

(57) ABSTRACT

A fan having a rotor with a plurality of fan blades, the fan having an intake and a pressure side. A blocking device between the intake and pressure sides of the fan. The blocking device comprising a strip-like brush element with a plurality of brush sections that extend radially upwardly toward the edge of the rotor. The brush sections are spaced apart from one another along the direction from the intake to the pressure side of the fan. A cross-flow fan has spaced apart brush sections which are spaced apart in the running direction of the fan. An axial flow fan has brush sections which are spaced apart from one another transversely with respect to the running direction. The brush sections in each of the fans may also be as in the other type of fan. The brush sections may define a v-shape extending from a common block or may be in spaced apart rows or may be individual tufts and the tufts may be staggered along the length of the brush.

19 Claims, 5 Drawing Sheets

VENTILATOR WITH BRUSH TYPE BLOCKING DEVICE

BACKGROUND OF THE INVENTION

The invention relates to a ventilator or fan having a blocking device between its intake and pressure sides.

DE 30 48 571 A1 discloses a cross-flow fan having a nondeformable blocking device between its intake side and its pressure side. In the cross-flow fan the device may also serve as a turbulence former. A seal gap is formed between the rotor or the fan blades arranged on the rotor and the blocking device. With the known blocking device, this seal gap is necessary, since the rotor always has a residual imbalance, does not run one hundred percent true and/or is subject to dynamic deformation in operation, for example in the event of impact loads. However, the aerodynamic properties of the cross-flow fan are dependent, inter alia, on the size of the seal gap.

DE 195 27 605 A1 discloses, inter alia, a blocking device between a stator and a rotor of a turbo machine. The blocking device may be designed as a brush with bristle ends that keep the gap very small. However, this variant has a drawback in that a significantly audible rotational noise is generated when the rotor rotates. This noise may be perceived as a whistling or humming which may be disturbing to the user of the fans.

SUMMARY OF THE INVENTION

Therefore, the object of the invention is to provide a fan of this type, and either a cross-flow fan or an axial flow fan, which does not present this drawback.

A fan according to the invention has a rotor with a plurality of fan blades and a blocking device arranged between the intake side and the pressure side of the fan. The blocking device comprises a strip-like brush having a plurality of brush sections which are spaced apart from one another along the direction between the intake and pressure sides of the fan. Surprisingly, this blocking device significantly reduces the noise emissions from the fan, as compared with a known brush type blocking device, even though the ends of a plurality of brush sections are now arranged opposite the rotor. Moreover, because the blocking device comprises a brush, the seal gap can be made very small, which has a beneficial effect on the aerodynamic properties of the fan. Furthermore, the blocking device of the invention is not limited to use only for cross-flow fans of the type described above. Rather, the blocking device can also be used for radial fans and for so-called axial fans, which have a propeller, or the like, as the rotor. In all of these fans, the blocking device according to the invention is arranged between the intake side and the pressure side.

In one exemplary embodiment, the rotor comprises a cross-flow fan rotor, and the brush sections are spaced apart from one another along the running direction of the rotor. As the rotor rotates, each blade moves past two brush sections in succession.

If the rotor is designed as a cross-flow fan rotor, it is preferable for the blocking device to either be arranged on a turbulence former of the cross-flow fan or for the blocking device to form the turbulence former.

In another exemplary embodiment, the rotor comprises an axial-fan rotor, and the brush sections are this time spaced apart from one another transversely with respect to the running direction of the rotor.

In an axial fan, the blocking device, at least over certain areas, may surround a housing opening in which the axial-fan rotor is present or is mounted. In an axial fan, the blocking device according to the invention allows the pressure compensation between the pressure side and the intake side to be substantially reduced, since the brush-like configuration of the blocking element makes it possible to achieve an infinitesimally small seal gap, i.e. almost zero.

In a particularly preferred exemplary embodiment of a cross-flow fan the brush sections are also spaced apart from one another transversely with respect to the running direction of the rotor. Surprisingly, it has also been found that a blocking element of this nature can reduce noise emission still further.

In an exemplary embodiment of an axial fan, the brush sections are also spaced apart from one another in the running direction of the rotor. This makes it possible to further reduce the noise of an axial fan.

An exemplary embodiment of a fan in which the blocking device has precisely two brush sections is particularly preferred. This configuration is advantageous in that a noise reduction which is extremely good in relative terms is achieved with little outlay.

Furthermore, an embodiment is preferred in which the brush sections that extend radially inwardly toward the rotor extend parallel to one another. Alternatively, the distance between the brush sections may increase in the direction toward the rotor. For example, a V-shaped arrangement of the brush sections diverging toward the rotor is possible.

An embodiment of the blocking device having brush sections which form continuous strips is preferred. For the cross-flow fan, this means that the brush sections preferably extend over the entire axial length of the rotor. For the axial fan, the brush sections surround the rotor in the housing, so that a continuous strip is formed.

In another exemplary embodiment, the strip-like brush sections have bristle-free zones. These brush sections are therefore not of continuous design.

To form a bristle section, it is also possible to provide a plurality of individual bristle tufts which are arranged next to one another in a row. In bristle-free zones, there are no bristle tufts.

In another exemplary embodiment of a blocking device, the ends of the bristles of the brush sections which face toward the rotor are at different distances from the rotor. The advantages described above are achieved with a brush which has bristles of different lengths.

According to a refinement of the invention, the bristle-free zones of one brush section lie opposite zones of the other brush section which have bristles. In this way, the brush sections, which are not of continuous design, are arranged offset with respect to one another.

Preferably, polyamide is used as the bristle material. However, it is also possible for the bristles, particularly at their ends facing toward the rotor, to contain polyamide.

Moreover, it is possible to use other suitable materials for the bristles, for example, metals, preferably steel, or metal alloys, thin metal strips or wires, or keratinous or composite materials, for example plastic-coated metal wires. An embodiment with a plastic film inserted between the bristles is also advantageous. Natural bristles may also be used as the bristle material.

A particularly preferred exemplary embodiment includes a blocking device in a single-row strip brush, as shown for example in DE 195 27 605 A1 mentioned above. But, this single-row strip brush has a brush-spreading element to form the brush sections. If appropriate, this spreader element may be retrofitted to a single-row strip brush. The bristle-spreading element is introduced between bristles, so that some of the bristles, as represented pictorially, are deflected to the left while the others are deflected to the right. Preferably, in this case, the bristle-spreading element is moved sufficiently deeply between the bristles for that element to virtually bear against the bristle carrier. The spreading element produces the v-shaped bristle configuration.

Other features and advantages of the present invention will become apparent from the following description of exemplary embodiments of the invention which refers to the accompanying drawings.

DETAILED DESCRIPTION OF EMBODIMENTS OF THE INVENTION

Figure 1:
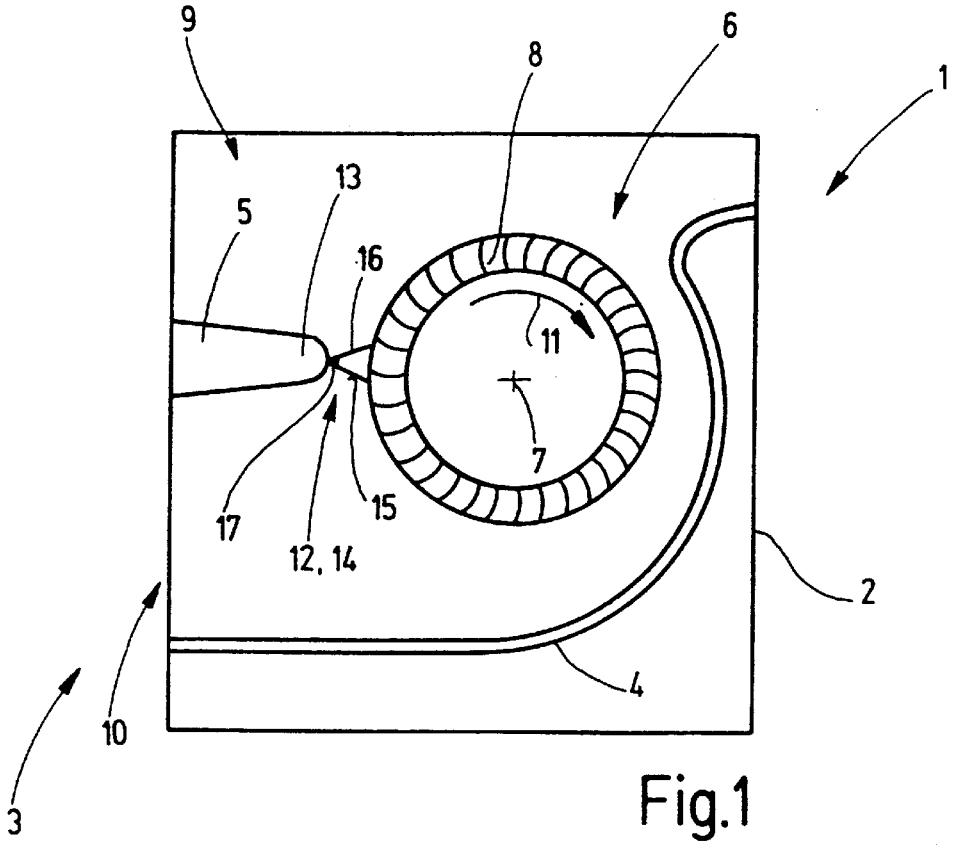
FIG. 1 shows a side view of a cross-flow fan including the invention.

FIG. 1 shows a side view of a cross-flow fan 1 which comprises a housing 2. An air-guidance device 3 is formed on the housing 2. It comprises an air-guidance plate 4 and a so-called turbulence former 5. The cross-flow fan 1 furthermore comprises a rotatably mounted rotor 6, which can be driven to rotate about its longitudinal axis 7. The rotor 6 has fan blades 8 which are held between two axially spaced apart support discs, not shown. When the rotor 6 rotates, an intake side 9 and a pressure side 10 are formed at the cross-flow fan 1. The direction of rotation of the fan 6 is therefore fixed in the clockwise direction, as indicated by an arrow 11.

The cross-flow fan 1 has a blocking device 12 which is arranged between the intake side 9 and the pressure side 10. In the embodiment of the cross-flow fan 1, the blocking device 12 is preferably arranged at the rotor-side end 13 of the turbulence former 5. The blocking device 12 comprises a generally strip-like brush 14 which comprises a plurality, in this case two, of brush sections 15 and 16 which extend over the axial direction length of the fan rotor. Starting radially outwardly from a bristle carrier 17 of the brush 14, which is arranged at the end 13 of the turbulence former, the brush sections 15 and 16 extend toward the circumferential surface of the rotor, i.e. toward the fan blades 8 and diverge. The radially inward, rotor-side ends of the brush sections 16 and 17 are at a distance from one another, in the direction of rotation 11 of the rotor 6. In the embodiment in FIG. 1, the brush sections 15 and 16 form a V, as seen in cross section.

Figure 2:
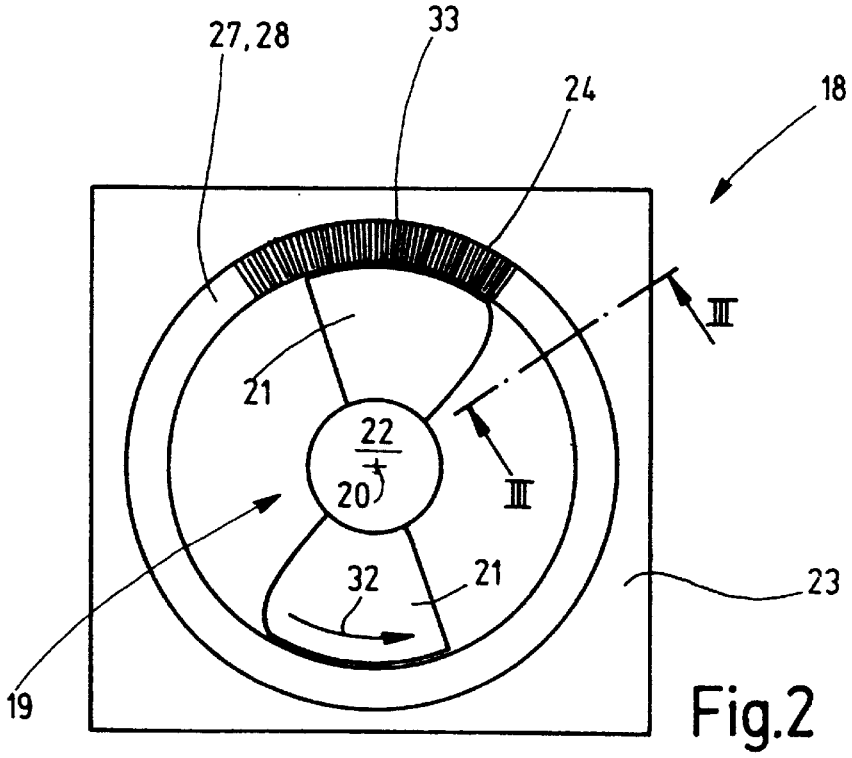
FIG. 2 shows an end view of an axial fan including the invention.
Figure 3:
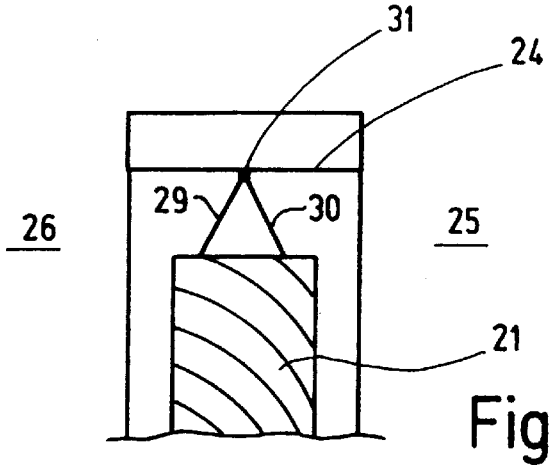
FIG. 3 shows a fragment of the axial fan in FIG. 2 in section on line III—III in FIG. 2.

FIG. 2 diagrammatically depicts an axial fan 18 which has a rotor 19 which is mounted to rotate about an axis of rotation 20. The rotor has fan blades 21 which extend radially outward from a rotor core 22. The rotor 19 is disposed in a housing 23 which has an aperture 24 in which the rotor is disposed. In operation, the rotor 19 produces an intake side 25 and a pressure side 26, as seen in FIG. 3.

A blocking device 27 formed as a generally strip-like brush 28, is arranged between the periphery of the aperture 24 and the ends of the fan blades 21. As shown in FIG. 3, the brush 28 has two brush sections 29 and 30, which extend inward from the periphery of the aperture 24 toward the fan blades 21. The brush sections 29 and 30 are secured in a bristle carrier 31 which is arranged at the periphery of the aperture 24. The rotor-side ends of the brush sections 29 and 30 are at an axial distance from one another, and are spaced transversely with respect to the direction of rotation 32 of the rotor 19. In the present embodiment, the brush sections 29 and 30 extend in a V shape, starting from the bristle carrier 31 toward the fan blades 21.

FIG. 2 shows that the strip-like brush 28 surrounds the inside periphery of the aperture 24. A strip-like brush 28 may be in the form of an elongate brush with ends that are attached to one another, producing a circular, continuous contour. Only some bristles 33 of the brush 28 are illustrated in FIG. 2.

Figure 4:
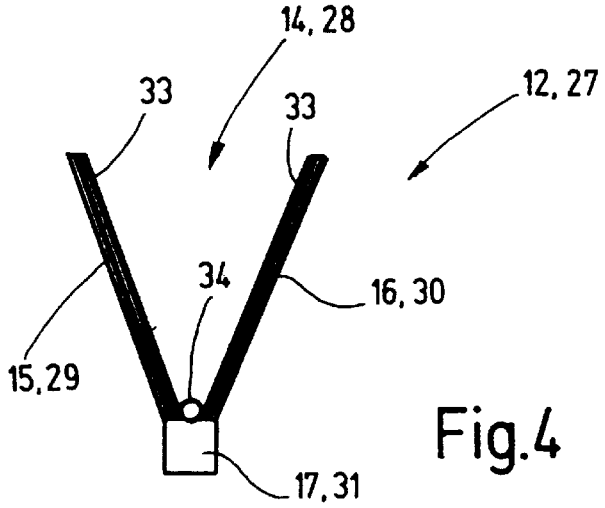
FIG. 4 shows a side view of a first embodiment of a blocking device of the invention.

FIG. 4 shows a blocking device 12 or 27, which has brush sections 15 or 29 and 16 or 30 which are arranged in a V-shape. FIG. 4 shows a single-row strip-like brush 12 or 27 being used, with the bristles 33 divided and held apart by a bristle-spreading element 34, so that the rotor-side ends of the brush sections 15, 16 or 29, 30 are at the above-mentioned distance from one another. To fix the bristle-spreading element 34 in place, it may be secured to the bristle carrier 17 or 31.

Figure 5:
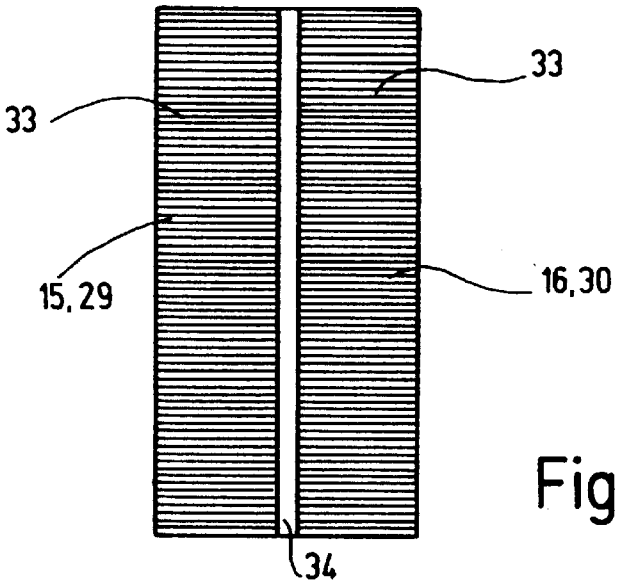
FIG. 5 shows a plan view of the blocking device in FIG. 4.

FIG. 5 shows a plan view of the blocking device 12 or 27 in FIG. 4. The illustrated brush sections 15, 29, 16, 30 each comprise continuous strips, i.e. bristles 33 are provided. The bristle-spreading element 34 also extends over the entire length of the brush sections 15, 29, 16, 30.

Figure 6:
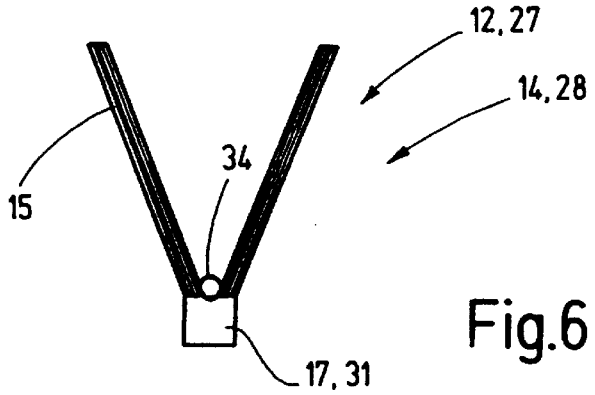
FIG. 6 shows a side view of a second embodiment of a blocking device of the invention.

FIG. 6 shows a second embodiment of the blocking device 12 or 27 with parts identical to those shown in previous Figures along the entire axial length having the same reference numerals noted above. The following text deals only with differences.

Figure 7:
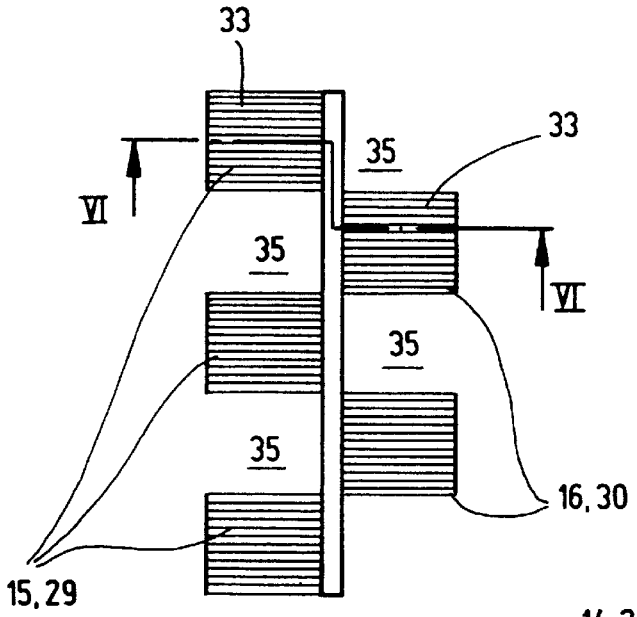
FIG. 7 shows a plan view of the blocking device in FIG. 6.

In contrast to the brush 24 or 28 shown in FIGS. 4 and 5, in FIGS. 6 and 7, the individual bristles 33 are not centrally divided by the bristle-spreading element 34, but rather all of the bristles at individual sections along the length of the brush are deflected to the left and right in respective sections. The brush sections 15 toward the left and 29 and 16, 30 toward the right which are formed in this way are not of continuous design, but rather have bristle-free zones 35 between neighboring bristle sections to the left or to the right. Consequently, the brush sections are at a distance from one another not only in the direction of rotation 11, 32 of the rotor 6, 19, but also transversely with respect to this direction, i.e., axially. The brush sections 15, 25 are "staggered" with respect to the brush sections 16, 30 as seen in FIF. 7.

Figure 8:
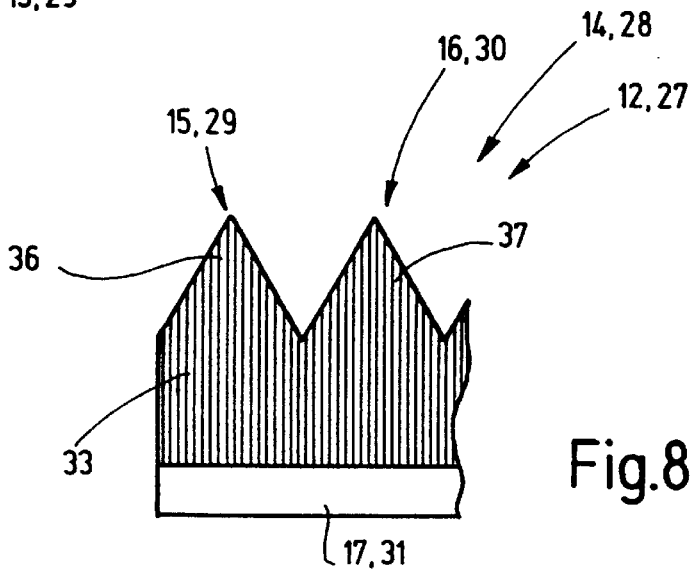
FIG. 8 shows a third embodiment of a blocking device of the invention.

FIG. 8 shows a third embodiment of a blocking device 12 or 27, in which the brush sections 15, 29 or 16, 30 are formed by bristles 33 which are originally of different lengths or by the bristles 33 which are cut to length at their ends subsequently, so that bristles are at different distances from the rotor 8, 19. The brush 14 or 28 shown in FIG. 8 may be designed in such a way that the bristle ends overall form a triangular or sawtooth contour. In FIG. 8, two triangular peaks 36 and 37 are shown. The blocking device 12 or 27 can be assigned to the rotor 6 or 19 in such a way that, when the rotor is rotating, the peaks 36 and 37 are successively touched by the fan blades 8 or the fan blades 8 move successively past the peaks 36 and 37. However, it is also to provide a plurality of peaks 36, 37, i.e. to form more than two brush sections.

If the blocking device 12, 27 shown in FIG. 8 is arranged on the housing 23 of the axial fan 18 with peaks oriented radially inwardly, the brush sections 15, 29 and 16, 30 define a continuous surrounding, so that the fan blades 21 rotate along the peaks 36 and 37 when the rotor 19 is rotating. The peaks 36, 37 are therefore aligned in such a way that the brush sections lie transversely with respect to the direction of rotation 32. Naturally, it is possible for the bristle sections shown in FIG. 8 to have bristle-free zones 35, as illustrated in FIG. 7.

Figure 9:
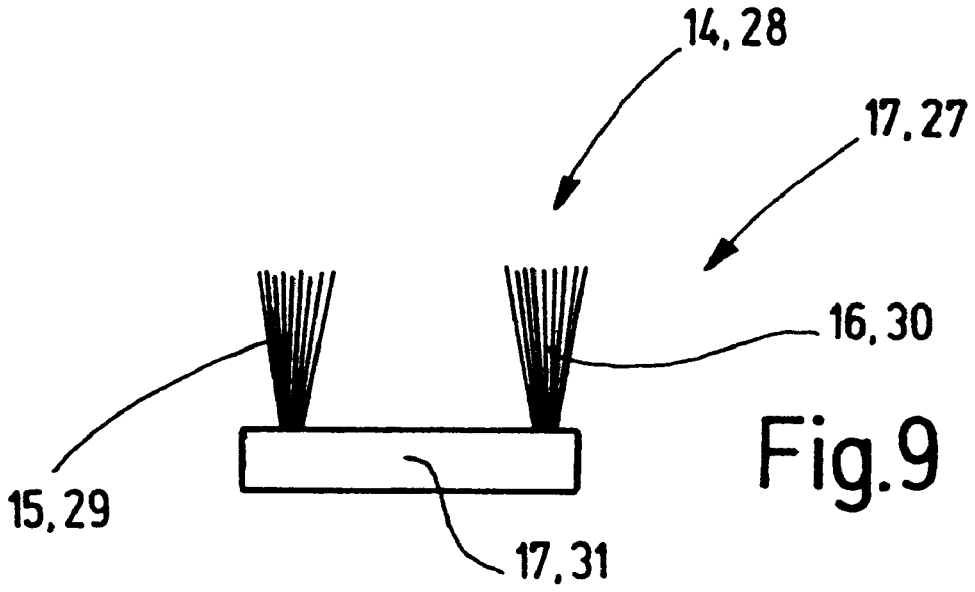
FIG. 9 shows a side view of a blocking device according to a fourth embodiment of the invention.
Figure 10:
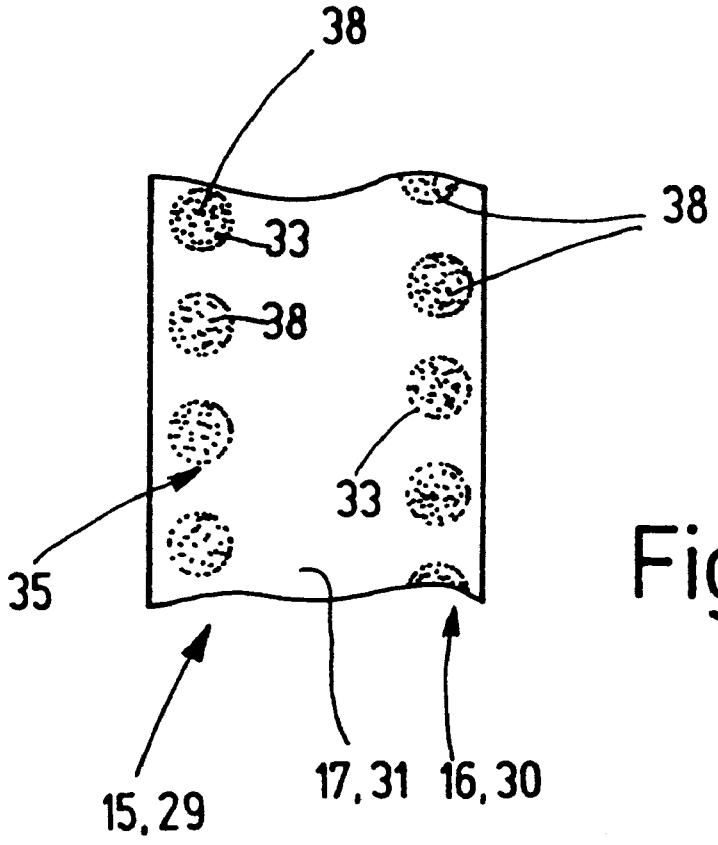
FIG. 10 shows a plan view of the blocking device in FIG. 9.

Finally, FIG. 9 shows a fourth embodiment of a blocking device 12 or 27. Although these brush sections 15, 29 and 16, 30 are at a distance from one another, they are not arranged in a V-shape, as in the preceding embodiments, but rather run substantially parallel to one another. Of course, the brush sections 15, 29 and 16, 30 shown in FIGS. 3 to 8 may also lie parallel to one another. The brush sections may comprise individual bristle tufts 38, so that a plurality of bristle tufts 38 are arranged in a row. This row lies transversely (cross-flow fan) or in the running direction (axial-flow fan). It is possible for individual bristle tufts 38 of a brush section 15 or 29 to be at a distance from one another. However, the bristle tufts 38 may also be arranged so close together as to form a virtually continuous brush section 15 or 29. The bristle tufts of the other brush section 16 or 30 are preferably arranged on the bristle carrier 17 or 31 in such a way that they are arranged opposite a bristle-free zone 35 of the brush section 15 or 29. The individual bristle tufts 38 of each brush section 15, 29 or 16, 30 are therefore arranged offset with respect to one another, i.e., the tufts at opposite sides are staggered, as can be seen from FIG. 10.

Otherwise, parts which are identical to or have the same function in FIGS. 1 to 10 are provided with the same reference numerals. Therefore, their description in the individual figures is to be referred to where appropriate.

Figure 11:
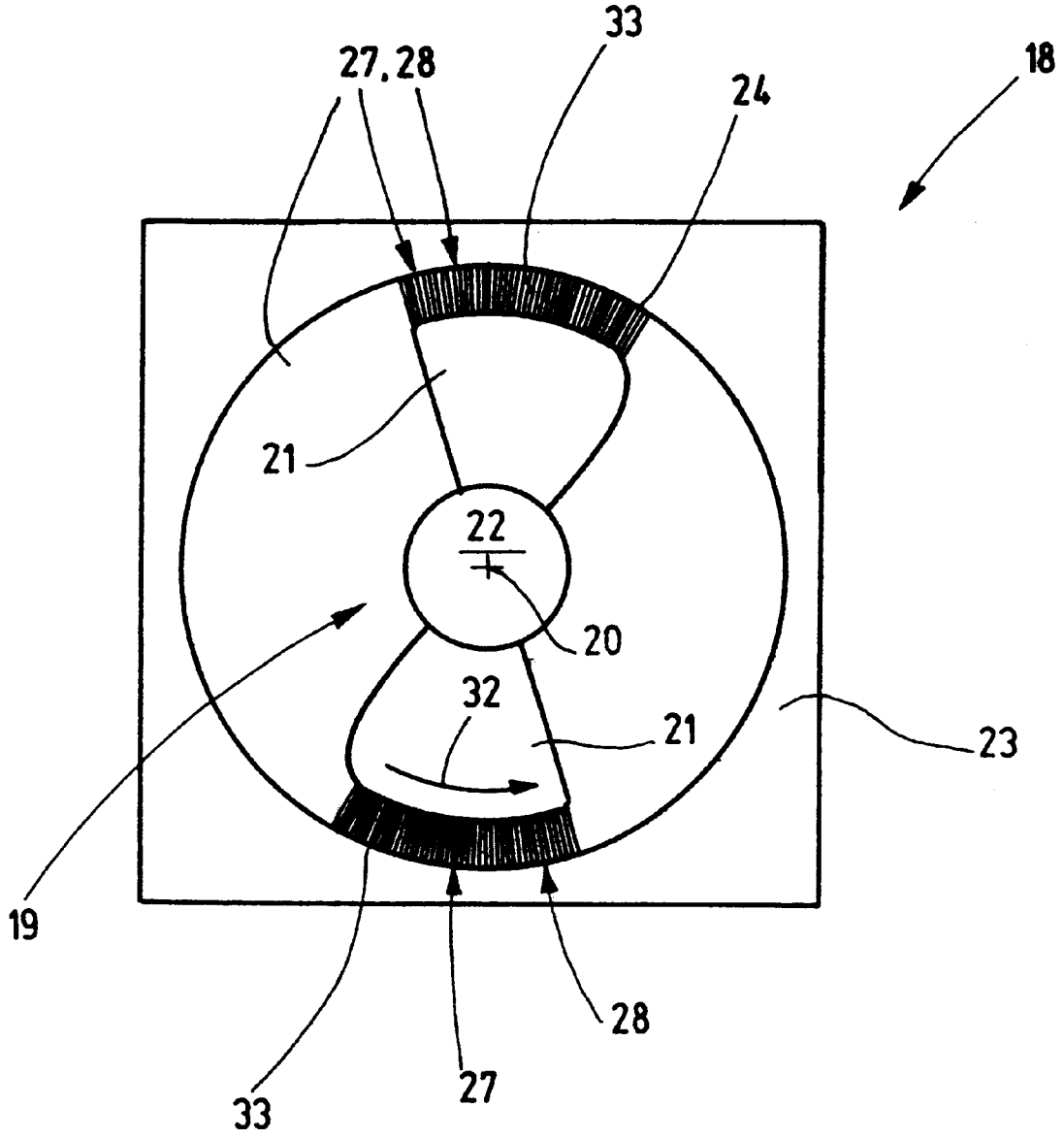
FIG. 11 shows a further embodiment of an axial fan including the invention.

FIG. 11 shows a further embodiment of an axial fan, which substantially corresponds to the embodiment shown in FIG. 2. The only difference is that the strip-like brush 28 is attached not to the periphery of the aperture 24, but rather to the radial outward ends of the fan blades 21 so that the brush 28 rotates with the rotor. The free ends of the bristles 33 of the brush 28 form an infinitesimally small gap with the periphery of the aperture 24.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A fan comprising:

a rotor having a plurality of fan blades thereon for rotating with the rotor, the fan having an intake side and an opposite pressure side defined by the orientation of the blades and the direction of rotation of the rotor;

a blocking device disposed between the intake side and the pressure side of the fan, the blocking device comprising a strip-like brush including a plurality of brush sections which are spaced apart from one another along the direction from the intake side to the pressure side of the fan.

2. The fan of claim 1, wherein the rotor and fan blades comprise a cross-flow fan rotor, and the brush sections are spaced apart from one another in the running direction of the rotor.

3. The fan of claim 2, further comprising a turbulence former between the intake and pressure sides of the fan, and the blocking device is arranged at the turbulence former.

4. The fan of claim 2, wherein the brush sections are spaced apart from one another transversely with respect to the running direction of the rotor.

5. The fan of claim 1, wherein the blades are located and oriented so that upon rotation of the rotor, the rotor is an axial fan rotor;

the brush sections being spaced apart from one another transversely with respect to the running direction of the fan blades.

6. The fan of claim 5, further comprising a housing around the fan rotor having an aperture therein shaped for receiving the fan rotor therein;

the blocking device, at least in certain areas thereof, provides a surrounding of the periphery of the aperture in which the rotor is contained.

7. The fan of claim 5, wherein the brush sections are also spaced apart from one another in the running direction of the rotor.

8. The fan of claim 1, wherein the brush sections are spaced apart from one another transversely with respect to the running direction of the rotor.

9. The fan of claim 1, wherein the blocking device comprises two spaced apart brush sections.

10. The fan of claim 1, wherein the brush sections extend parallel to one another along the direction.

11. The fan of claim 8, wherein the brush sections are oriented to extend at an increasing distance from one another in the radial direction of the brush sections extending toward the rotor.

12. The fan of claim 1, wherein the brush sections are oriented to extend at an increasing distance from one another in the radial direction of the brush sections extending toward the rotor.

13. The fan of claim 1, wherein the brush sections are in the form of continuous strips.

14. The fan of claim 1, wherein the brush sections are strip-like and each section includes a plurality of bristle free zones therealong.

15. The fan of claim 14, wherein each of the brush sections comprises individual bristle zones and each bristle zone comprises a plurality of bristle tufts and the bristle zones are arranged next to each other in a row.

16. The fan of claim 1, wherein the bristles in the brush sections have ends which face toward the rotor and the ends of bristles of the brush sections facing toward the rotor are at different distances from the rotor, with some nearer and some further radially from the rotor.

17. The fan of claim 14, wherein each of the brush sections has respective bristle free zones so positioned along the brush section that a bristle free zone of each brush section lies opposite a zone of the other brush section which has bristles.

18. The fan of claim 1, wherein the blocking device brush comprises a single row strip brush;

a bristle spreading element applied to the bristles for spreading the bristles to one or the other side of the spreading element, thereby defining the plurality of brush sections.

19. The fan of claim 1, wherein the bristles are of a material selected from the group consisting of polyamide, metal, natural fibers, and at least one of the foregoing with other materials.

* * * * *